US007429162B2

(12) United States Patent
Lee et al.

(10) Patent No.: US 7,429,162 B2
(45) Date of Patent: Sep. 30, 2008

(54) FAN

(75) Inventors: Chin-Hong Lee, Taoyuan Hsien (TW); Shun-Chen Chang, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 567 days.

(21) Appl. No.: 11/121,113

(22) Filed: May 4, 2005

(65) Prior Publication Data

US 2006/0045738 A1 Mar. 2, 2006

(30) Foreign Application Priority Data

Aug. 27, 2004 (TW) ..... 93125866 A

(51) Int. Cl.
*F04D 29/54* (2006.01)

(52) U.S. Cl. ..... 415/211.2; 415/220

(58) Field of Classification Search ..... 415/211.2, 415/220, 207

See application file for complete search history.

(56) References Cited

U.S. PATENT DOCUMENTS 4,482,302 A * 11/1984 Grignon ..... 415/220
5,707,205 A 1/1998 Otsuka et al.
6,544,010 B1 4/2003 Choi et al.
6,547,540 B1 4/2003 Horng et al.
6,939,113 B2 * 9/2005 Otsuka et al. ..... 417/354

FOREIGN PATENT DOCUMENTS

| | | | |
|---|---|---|---|
| CN | 1504649 | A | 6/2004 |
| CN | 2627254 | Y | 7/2004 |
| DE | 103 58 917 | A1 | 12/2004 |
| JP | 58-175200 | U | 11/1983 |
| JP | 61-502267 | A | 10/1986 |
| JP | 8-28491 | A | 1/1996 |
| JP | 2000-205194 | A | 7/2000 |
| JP | 2001-304193 | A | 10/2001 |
| JP | 3083969 | U | 11/2001 |
| JP | 3101363 | U | 2/2004 |
| JP | 2004-132300 | A | 4/2004 |
| JP | 2004-169680 | A | 6/2004 |

* cited by examiner

*Primary Examiner*—Richard Edgar
(74) *Attorney, Agent, or Firm*—Birch, Stewart, Kolasch & Birch, LLP

(57) ABSTRACT

A fan includes a frame, a motor base, an impeller, an airflow guiding component, and at least one outwardly expanded part. The motor base is disposed in the frame, and the impeller is disposed on the motor base. The outwardly expanded part, connected with the frame, is disposed at an airflow inlet or an airflow outlet, for increasing areas of intake airflow or discharge airflow. One end of the airflow guiding component is connected with the motor base, and the other end is connected with an inner surface of the frame, instead of being connected with the outwardly expanded part, to prevent the fan from forming blocks on the frame during molding process.

24 Claims, 4 Drawing Sheets

FAN

This Non-provisional application claims priority under U.S.C. § 119(a) on Patent Application No(s). 093125866 filed in Taiwan, Republic of China on Aug. 27, 2004, the entire contents of which are hereby incorporated by reference.

BACKGROUND

The invention relates to a fan and in particular to an axial-flow fan.

Heat dissipation devices or systems are commonly used in electronic devices. A heat dissipation device can dissipate heat generated by an electronic device, thus preventing the electronic device from overheating or burnout. Heat dissipation devices are particularly important to micro-electronic devices, such as integrated circuits. The dimensions of integrated circuits decrease as circuit density increases and packaging technology evolves. Accordingly, heat per unit area is higher.

Currently, the most commonly used heat dissipation device is a fan. Referring to FIGS. 1 and 2, which are schematic diagrams of conventional fans, in FIG. 1, the conventional fan 10 includes a frame 11, a motor base 12, an impeller 13, a plurality of blades 14, and several ribs 15*a*. The frame 11 is a casing having an opening, and the motor base 12 is disposed in the frame 11. Each of the rib 15*a* is connected between the motor base 12 and the frame 11. Alternatively, as shown in FIG. 2, the conventional fan 10 uses static blades 15*b* instead of ribs to be connected between the motor base 12 and the frame 11. However, an unwanted block 19 is generated where the frame 11 is connected with the rib 15*a* or the static blade 15*b* due to molding limitations, thus blocking airflow and producing excess noise when the speed of the fan increases.

SUMMARY

Fans are provided. An exemplary embodiment of a fan includes a frame, a motor base, an impeller, an airflow guiding component, and at least one outwardly expanded part. The frame includes a cylindrical passageway, wherein two ends of the cylindrical passageway constitute an airflow inlet and an airflow outlet on the frame respectively. The motor base is disposed in the frame. The impeller is disposed on the motor base. The airflow guiding component is disposed between the frame and the motor base. The outwardly expanded part is connected with the frame and disposed at the airflow inlet or the airflow outlet for increasing areas of intake airflow or discharge airflow. One end of the airflow guiding component is connected with the motor base, and the other end is connected with an inner surface of the cylindrical passageway.

Some embodiments of a fan include a frame, a motor base, an impeller, an airflow guiding component, and at least one outwardly expanded part. The frame includes an opening, wherein two ends of the opening constitute an airflow inlet and an airflow outlet on the frame respectively. The motor base is disposed in the frame, and the impeller is disposed on the motor base. The airflow guiding component is disposed between the frame and the motor base. The airflow guiding component includes an outer edge and an inner edge, wherein the outer edge faces the outside of the frame, and the inner edge faces the inside of the frame. The outwardly expanded part is connected with the frame and disposed at the airflow inlet or the airflow outlet for increasing the size of the airflow area, wherein a connection point of the outer edge and the frame is located on the frame or where the outwardly expanded part is connected to the frame.

DESCRIPTION OF THE DRAWINGS

The invention can be more fully understood by reading the subsequent detailed description and examples with references made to the accompanying drawings, wherein.

DETAILED DESCRIPTION

Figure 1:
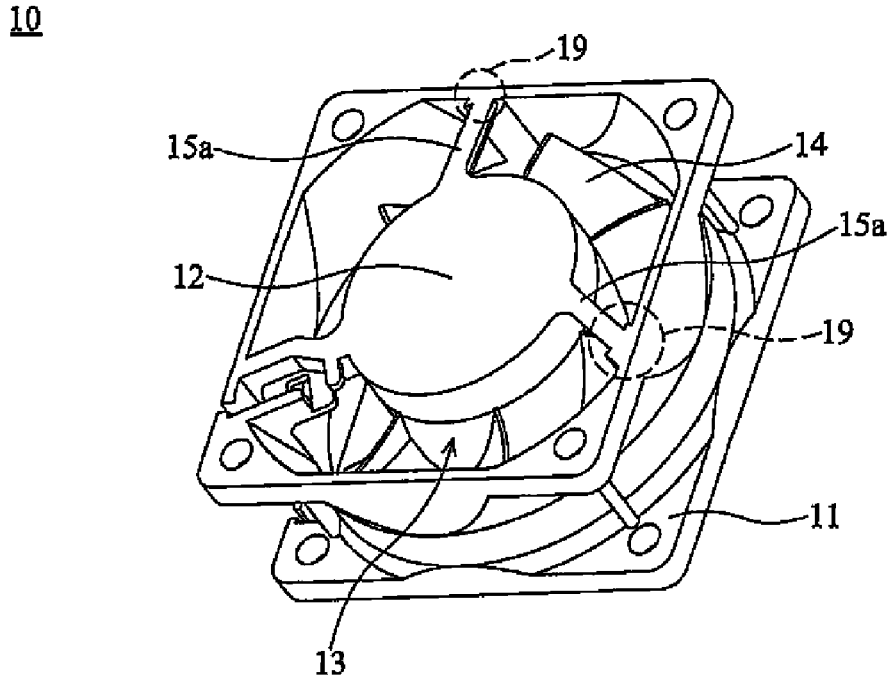
FIG. 1 ( PRIOR ART )
FIGS. 1-2 are schematic diagrams of conventional fans.
Figure 2:
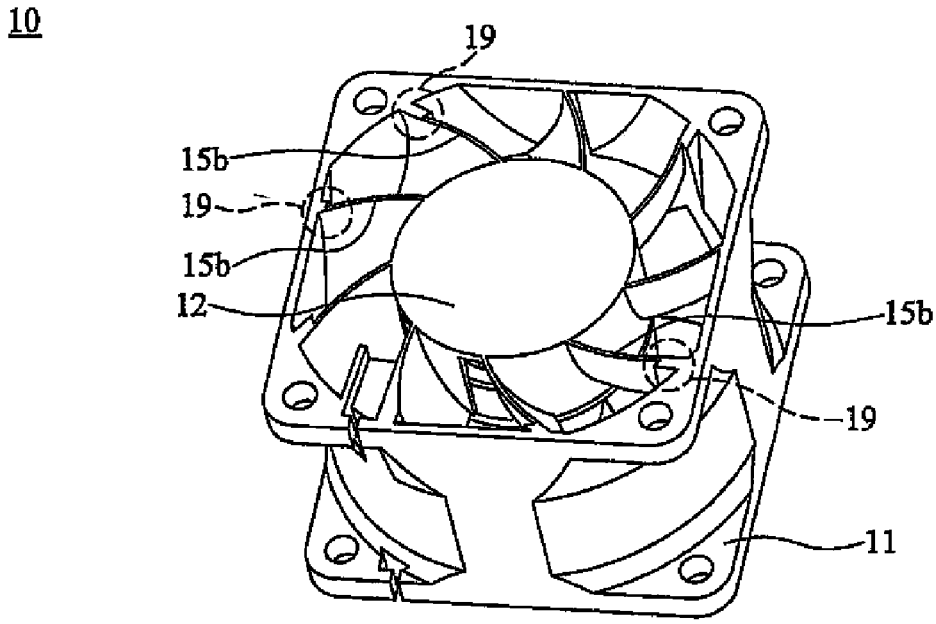
FIG. 2 ( PRIOR ART )
Figure 3:
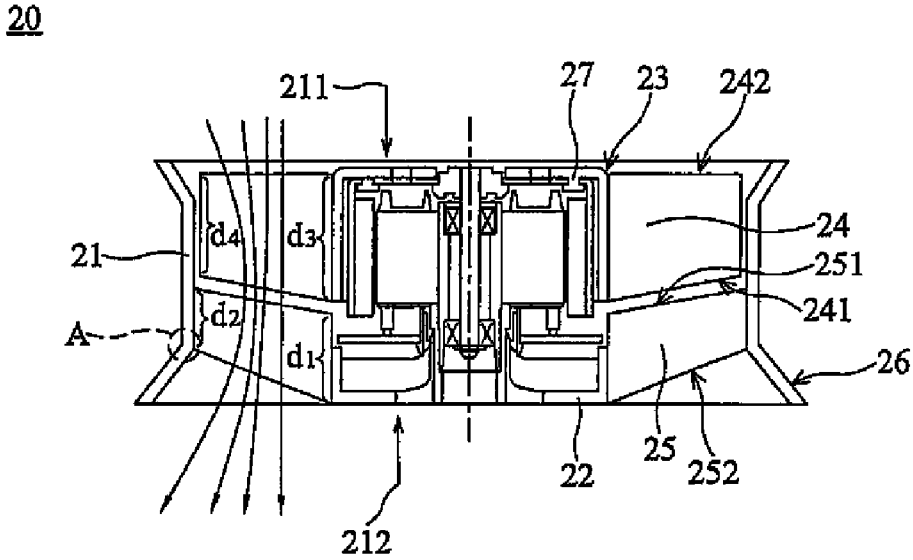
FIG. 3 is a cross-section of an embodiment of a fan.
Figure 4:
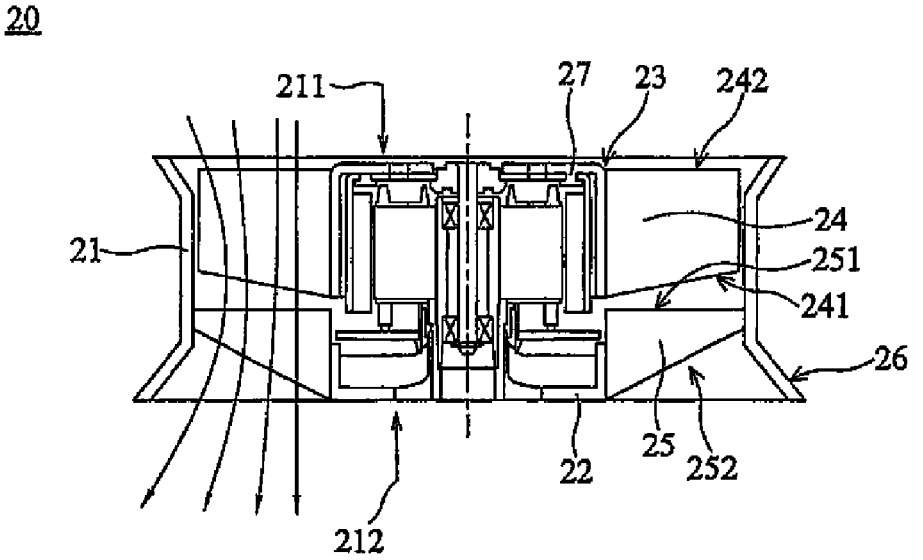
FIG. 4 is a cross-section of another embodiment of a fan.

Fans will be described in greater detail in the following. Referring to FIGS. 3 and 4, FIG. 3 is a cross-section of an embodiment of a fan. FIG. 4 is a cross-section of another embodiment of a fan. The fan 20 is preferred an axial-flow fan, and includes a frame 21, a motor base 22, an impeller 23, an airflow guiding component 25, and at least one outwardly expanded part 26. The airflow guiding component 25 is a rib or a static blade, and the outwardly expanded part 26 has a taper angle, a bevel angle, a taper bevel angle, or a large R angle.

The frame 21 includes an opening constituting a cylindrical passageway therein. Two ends of the cylindrical passageway constitute an airflow inlet 211 and an airflow outlet 212 on the frame 21 respectively. The motor base 22 is disposed in the frame 21, and the impeller 23 is disposed on the motor base 22. The airflow guiding component 25 is disposed between the frame 21 and the motor base 22. The outwardly expanded part 26 is disposed at the airflow inlet 211 or the airflow outlet 212 for increasing areas of intake airflow or discharge airflow. The outwardly expanded part 26 is connected with the frame 21.

The impeller 23 includes a hub 27 and a plurality of blades 24. Each blade 24 is connected with the hub 27, and each blade 24 includes a first edge 241 and a second edge 242. The first edge 241 faces the airflow guiding component 25, and the second edge 242 faces back to the airflow guiding component 25.

One end of the airflow guiding component 25 is connected with the motor base 22, and the other end is connected with an inner surface of the cylindrical passageway. In other words, the airflow guiding component 25 includes an outer edge 252 and an inner edge 251. The outer edge 252 faces the outside of the frame 21, and the inner edge 251 faces the inside of the frame 21. A connection point of the outer edge 252 and the frame 21 is located on the frame 21 or where the outwardly expanded part 26 is connected to the frame 21, as shown in FIG. 3.

The outer edge 252 and a surface of the frame are not on the same plane, hence the airflow guiding component 25 is raised to the frame 21 to form a jump depth, thus preventing blocks from forming at connections of the frame and the static blade. Also, the jump depth can stabilize airflow. Furthermore, an outwardly expanded part 26 can be disposed on the frame 21 for be associating with the jump depth, whereby areas of intake airflow or discharge airflow are increased. Additionally, while the outwardly expanded part 26 is disposed at the airflow outlet 212, it can reduce airflow speed and rectifies airflow efficiently.

The airflow guiding components 25 are disposed between the frame 21 and the motor base 22 in radial or axial style. The airflow guiding component 25 has a pillared, arc, polyhedral, polygonal, or streamlined shape. The outer edge 252 and the inner edge 251 of the airflow guiding component 25 can be parallel or not parallel. For example, in FIG. 3, the outer edge 252 of the airflow guiding component 25 gradually approaches the inner edge 251 along the direction from the motor base 22 to the frame 21. Alternatively, the outer edge 252 of the airflow guiding component 25 is gradually separated from the inner edge 251 along the direction from the motor base 22 to the frame 21. In FIG. 3, the distance d1 between where the outer edge 252 is connected to the motor base 22 and where the inner edge 251 is connected to the motor base 22 is equal to/greater than the distance d2 between where the outer edge 252 is connected to the frame 21 and where the inner edge 251 is connected to the frame 21. Alternatively, the distance d1 between where the outer edge 252 is connected to the motor base 22 and where the inner edge 251 is connected to the motor base 22 is less than the distance d2 between where the outer edge 252 is connected to the frame 21 and where the inner edge 251 is connected to the frame 21.

The first edge 241 and the second edge 242 of the blade 24 can be parallel or not parallel. For example, in FIG. 3, the first edge 241 of the blade 24 gradually approaches the second edge 242 of the blade 24 along the direction from the hub 27 to the frame 21. Alternatively, the first edge 241 of the blade 24 is gradually separated from the second edge 242 of the blade 24 along the direction from the hub 27 to the frame 21. In FIG. 3, the distance d3 between where the first edge 241 is connected to the hub 27 and where the second edge 242 is connected to the hub is equal to/greater than the distance d4 between where the first edge 241 is connected to a tail end of the blade 24 and where the second edge 242 is connected to the tail end of the blade 24. Alternatively, the distance d3 between where the first edge 241 is connected to the hub 27 and where the second edge 242 is connected to the hub is less than the distance d4 between where the first edge 241 is connected to the tail end of the blade 24 and where the second edge 242 is connected to the tail end of the blade 24.

When the impeller 23 is disposed on the motor base 22, the first edge 241 of the blade 24 faces the inner edge 251 of the airflow guiding component 25. The blade 24 and the airflow guiding component 25 can have various designs according to different requirements. For example, the first edge 241 of the blade 24 and the inner edge 251 of the airflow guiding component 25 can be parallel (as shown in FIG. 3) or not (as shown in FIG. 4). In FIG. 4, the first edge 241 of the blade 24 is gradually separated from the inner edge 251 of the airflow guiding component 25 along the direction from the hub 27 to the frame 21. Alternatively, the first edge 241 of the blade 24 gradually approaches the inner edge 251 of the airflow guiding component 25 along the direction from the hub 27 to the frame 21.

When the impeller 23 rotates, airflow speed increase as it approaches the tail end of the blade 24. In other words, the airflow speed at the frame 21 is greater than the airflow speed at the motor base 22. In an embodiment of the invention, airflow drag between the first edge 241 and the inner edge 251 can be reduced, thus decreasing noise.

Figure 5:
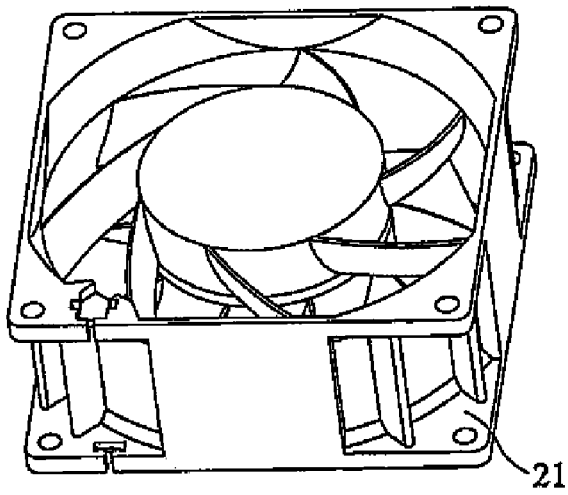
FIG. 5 is a schematic diagram of an embodiment of a fan.
Figure 6:
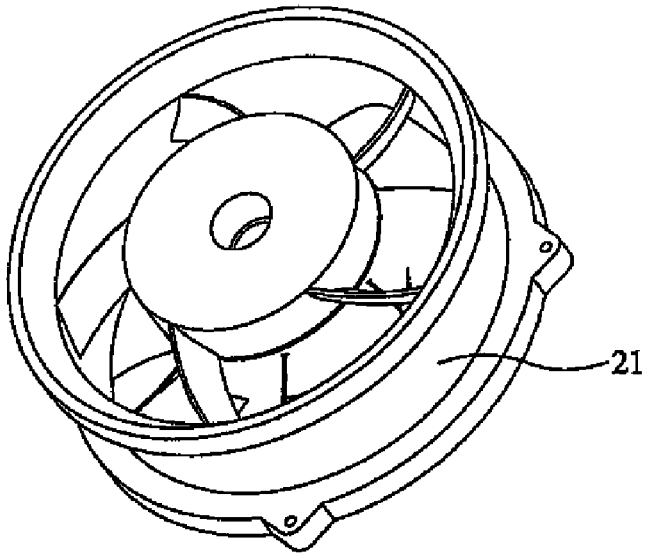
FIG. 6 is a schematic diagram of another embodiment of a fan.

Additionally, the laterals of the motor base 24 has a slope inclined radially for increasing areas of intake airflow or discharge airflow, and the slope is flat or curved. Referring to FIGS. 5 and 6, FIG. 5 is a schematic diagram of an embodiment of a fan. FIG. 6 is a schematic diagram of another embodiment of a fan. The shape of the frame 21 can vary and may be a substantially rectangle (as shown in FIG. 5), a circle (as shown in FIG. 6), an oval, or a rhombus.

Figure 7:
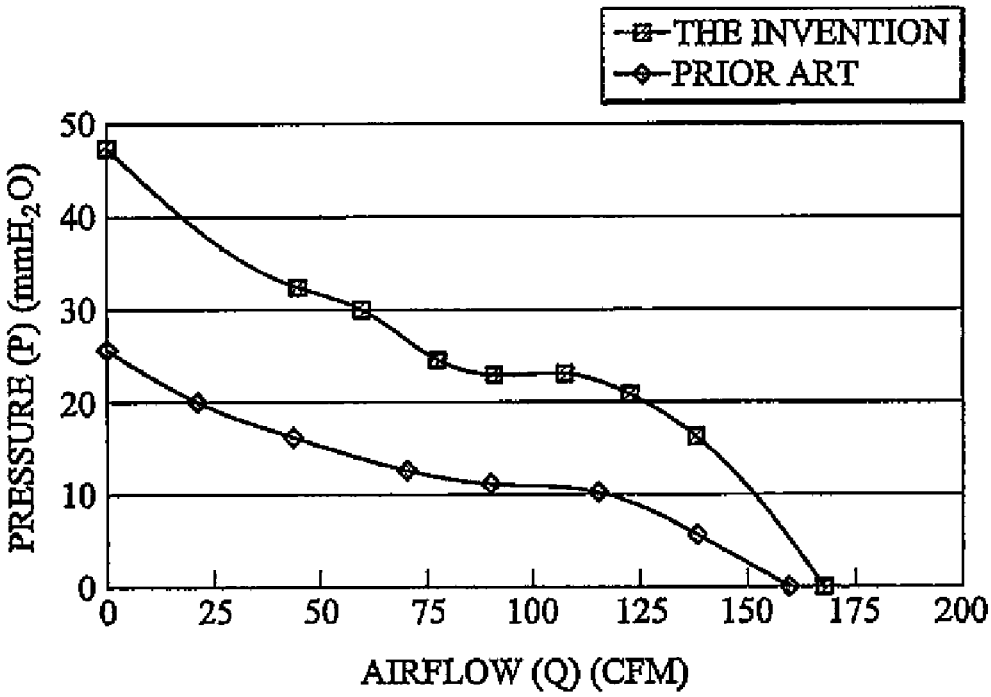
FIG. 7 is a P-Q chart comparing characteristics of the conventional fan and an embodiment of a fan.

Referring to FIG. 7, FIG. 7 is a P-Q chart comparing characteristics of the conventional fan and an embodiment of a fan. FIG. 7 shows that airflow pressure and volume of an embodiment of a fan is greater than those of the conventional fan. For example, when the airflow volume(Q) is 90 CFM, the airflow pressure(P) of the conventional fan is only 11.3 $mmH_2O$, while the airflow pressure(P) of the fan is 22.7 $mmH_2O$. When the airflow pressure(P) is 16.7 $mmH_2O$, the airflow volume(Q) of the conventional fan is only 44 CFM, while the airflow volume(Q) of the fan is 139.5 CFM. Additionally, if the conventional fan and an embodiment of the fan of the same dimensions of 9 cm are tested at the same rotational speed of 6000 rpm, the highest noise values measured at a distance of 1 m from the airflow inlet of each fan are as follows: 63 dBA for the conventional fan and 58.5 dBA for an embodiment of the fan. Therefore, the fan is advantageous for increasing airflow pressure and volume, reducing noise and airflow speed, and rectifying airflow.

While the invention has been described by way of example and in terms of several embodiments, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fan, comprising:

a frame comprising a cylindrical passageway, wherein two ends of the cylindrical passageway constitute an airflow inlet and an airflow outlet on the frame respectively;

a motor base disposed in the frame;

an impeller disposed on the motor base;

an airflow guiding component disposed between the frame and the motor base; and at least one outwardly expanded part connected with the frame and disposed at the airflow inlet or the airflow outlet for increasing areas of intake airflow or discharge airflow;

wherein one end of the airflow guiding component is connected with the motor base, and the other end is connected with an inner surface of the cylindrical passageway for defining a space between a bottom end of the frame, the outwardly expanded part, and an outer edge of the airflow guiding component facing an outside of the frame.

2. The fan as claimed in claim 1, wherein the airflow guiding component further comprises an inner edge which faces an inside of the frame, and the outer edge and the inner edge are parallel or not parallel.

3. The fan as claimed in claim 2, wherein the outer edge of the airflow guiding component gradually approaches the inner edge of the airflow guiding component along the direction from the motor base to the frame, or the outer edge of the airflow guiding component of the blade is gradually separated from the inner edge of the airflow guiding component along the direction from the motor base to the frame.

4. The fan as claimed in claim 2, wherein the distance between where the outer edge is connected to the motor base and where the inner edge is connected to the motor base is equal to/greater than the distance between where the outer edge is connected to the frame and where the inner edge is connected to the frame.

5. The fan as claimed in claim 1, wherein the impeller comprises a hub and a plurality of blades connected with the hub, and each blade comprises a first edge facing the airflow guiding component and a second edge facing back to the airflow guiding component.

6. The fan as claimed in claim 5, wherein the first edge and the second edge of the blade are not parallel.

7. The fan as claimed in claim 5, wherein the first edge of the blade and an inner edge of the airflow guiding component are not parallel.

8. The fan as claimed in claim 5, wherein the first edge and the second edge of the blade are parallel.

9. The fan as claimed in claim 8, wherein the first edge of the blade gradually approaches the second edge of the blade along the direction from the hub to the frame, or the first edge of the blade is gradually separated from the second edge of the blade along the direction from the hub to the frame.

10. The fan as claimed in claim 8, wherein the distance between where the first edge is connected to the hub and where the second edge is connected to the hub is equal to/greater than the distance between where the first edge is connected to a tail end of the blade and where the second edge is connected to the tail end of the blade.

11. The fan as claimed in claim 5, wherein the first edge of the blade and an inner edge of the airflow guiding component are parallel.

12. The fan as claimed in claim 11, wherein the first edge of the blade gradually approaches the inner edge of the airflow guiding component along the direction from the hub to the frame, or the first edge of the blade is gradually separated from the inner edge of the airflow guiding component along the direction from the hub to the frame.

13. The fan as claimed in claim 1, wherein the airflow guiding component is a rib or a static blade.

14. The fan as claimed in claim 1, wherein the outwardly expanded part has taper angle, a bevel angle, a taper bevel angle, or a large R angle, and the frame has a substantially rectangular, circular, oval, or rhombic shape.

15. The fan as claimed in claim 1, being an axial-flow fan.

16. The fan as claimed in claim 1, wherein laterals of the motor base comprises a slope inclined radially for increasing areas of intake airflow or discharge airflow.

17. The fan as claimed in claim 16, wherein the slope is flat.

18. The fan as claimed in claim 16, wherein the slope is curved.

19. A fan, comprising:

a frame comprising an opening, wherein two ends of the opening constitute an airflow inlet and an airflow outlet on the frame respectively;

a motor base disposed in the frame;

an impeller disposed on the motor base;

an airflow guiding component disposed between the frame and the motor base and comprising an inclined outer edge and an inner edge, wherein the outer edge faces an outside of the frame, and the inner edge faces an inside of the frame; and at least one outwardly expanded part connected with the frame and disposed at the airflow inlet or the airflow outlet for increasing areas of intake airflow or discharge airflow;

wherein a connection point of the outer edge and the frame is located on the frame or where the outwardly expanded part is connected to the frame.

20. The fan as claimed in claim 19, wherein the outer edge of the airflow guiding component and the inner edge of the airflow guiding component are parallel.

21. The fan as claimed in claim 20, wherein the outer edge of the airflow guiding component gradually approaches the inner edge of the airflow guiding component along the direction from the motor base to the frame, or the outer edge of the airflow guiding component is gradually separated from the inner edge of the airflow guiding component along the direction from the motor base to the frame.

22. The fan as claimed in claim 20, wherein the distance between where the outer edge is connected to the motor base and where the inner edge is connected to the motor base is equal to/greater than the distance between where the outer edge is connected to the frame and where the inner edge is connected to the frame.

23. The fan as claimed in claim 19, wherein the impeller comprises a hub and a plurality of blades connected with the hub, and each blade comprises a first edge facing the airflow guiding component and a second edge facing back to the airflow guiding component, and the first edge and the second edge of the blade are parallel or not parallel.

24. The fan as claimed in claim 19, wherein the outer edge of the airflow guiding component and the inner edge of the airflow guiding component are not parallel.

* * * * *